US005863154A

United States Patent [19]

Olsen

[11] Patent Number: 5,863,154

[45] Date of Patent: Jan. 26, 1999

[54] METHOD AND APPARATUS FOR INSTALLING GROUND RODS

[76] Inventor: William Olsen, 3035 N. Range, Colby, Kans. 67701

[21] Appl. No.: 726,530

[22] Filed: Oct. 7, 1996

[51] Int. Cl.[6] ..... E02D 7/02

[52] U.S. Cl. ..... 405/232

[58] Field of Search ..... 405/232, 251, 405/245, 249; 175/135

[56] References Cited

U.S. PATENT DOCUMENTS

| | | | |
|---|---|---|---|
| 2,147,828 | 2/1939 | Daniels . | |
| 2,327,616 | 8/1943 | Abramson . | |
| 3,187,513 | 6/1965 | Guild | 405/232 X |
| 3,526,283 | 9/1970 | Horstketter et al. | 145/135 X |
| 3,847,230 | 11/1974 | Blomquist | 405/232 X |
| 4,665,994 | 5/1987 | Snider . | |
| 4,688,969 | 8/1987 | Bruser . | |
| 4,971,479 | 11/1990 | Byers et al. . | |
| 4,989,677 | 2/1991 | Lam . | |
| 5,010,710 | 4/1991 | Gray . | |
| 5,174,388 | 12/1992 | Williams . | |
| 5,337,836 | 8/1994 | Williams . | |
| 5,392,866 | 2/1995 | White . | |

*Primary Examiner*—Tamara L. Graysay
*Assistant Examiner*—Frederick L. Lagman
*Attorney, Agent, or Firm*—Bruce J. Clark

[57] ABSTRACT

A ground rod installation device and method as shown for pressing ground rods into the earth using hydraulic drilling equipment. The device has a plunger mechanism attachable to a Kelly Bar of the hydraulic drilling equipment utilizing a removable pin, a first cylindrical telescoping member through which the plunger is slidably attached, and a second telescoping member through which the first telescoping member is slidably attached. The ground rod is inserted into the fully extended telescoping members, placed above the desired location and driven into the ground without pre-drilling, pre-placing holes and in one substantially continuous drive stroke.

15 Claims, 5 Drawing Sheets

METHOD AND APPARATUS FOR INSTALLING GROUND RODS

BACKGROUND AND SUMMARY OF THE INVENTION

This invention relates to the field of installing ground rods into the earth. Ground rods are commonly used in association with utility poles so as to prevent damage caused by lightening, large electrical surges, stray voltages and the like. Ground rods are extremely elongated, narrow rods of high density conductive metal or other core conductive metal. They commonly come in eight foot lengths and are installed into the earth in the vicinity of the utility pole during installation of the utility pole. Quite often ground rods are interconnected using couplers and driven 7 to 16 feet into the earth depending on whether hard rock may be encountered. Upon installation, the ground rod is physically connected to the utility pole by electrically conductive wire.

Installation of these ground rods has customarily been by a number of methods, including impacting devices that repeatedly hammer one end of the rod. Impacting devices are somewhat cumbersome, particularly compared to the invention herein. Impacting also tends to more easily cause the rod to bend and deform.

Another method often used is drilling or boring. However, as will be seen, such method is time consuming compared to the invention herein.

Other drivers, pushers and impacters, and methods using them, may be time consuming, expensive, cumbersome, and the devices themselves are often complicated.

What is needed is a simple, efficient and effective device using the equipment commonly available during installation of utility poles and the like, and that is also economical to build and use, and it is to these objectives the present invention is directed.

As will be seen, during installation of utility poles, and most instances a common drilling rig is on site that would have been used for drilling the utility pole hole. A very common device attached to these drilling rigs is a Kelly Bar to which many drilling attachments, such as the drill itself, are removabley attached.

Consequently the present invention is directed toward its attachability to a Kelly Bar or the like using a pin attachment to a plunger. Two additional telescoping pieces slidably connected to the plunger having what are commonly referred to as "dogs" to hold the telescoping pipes together when extended. The device, upon being installed on the Kelly Bar, is raised above the location where the ground rod is to be inserted, the ground rod is then inserted into the Kelly Bar and the Kelly Bar is then lowered which then lowers the plunger (connected to the Kelly Bar) through the telescoping members, preferably aluminum. The significant forces of the hydraulic pressures available force the ground rod device into the earth. The telescoping devices help maintain the stability of the rod so as to prevent bending of the rod. The drill operator can normally feel when the device has hit rock, and if it has not, the device can be lifted, a coupler added to the rod, another rod added and continued to be driven down into the earth by repeating the process. The plunging or driving process takes only a few seconds and the entire process, including moving the drill bit and placing the invention on the Kelly Bar, takes only a matter of minutes.

The installation device itself, as will be seen, is easy and inexpensive to build, easy to use and effective, reliable, and extremely efficient and labor saving, particularly in an industry where labor costs tend to be significant.

Other objects and features of the invention and the manner in which the invention achieves its purpose will be appreciated from the foregoing and the following description and the accompanying drawings which exemplify the invention, it being understood that changes may be made in the specific method and apparatus disclosed herein without departing from the essentials of the invention set forth in the appended claims.

DESCRIPTION OF THE PREFERRED EMBODIMENT

Figure 1:
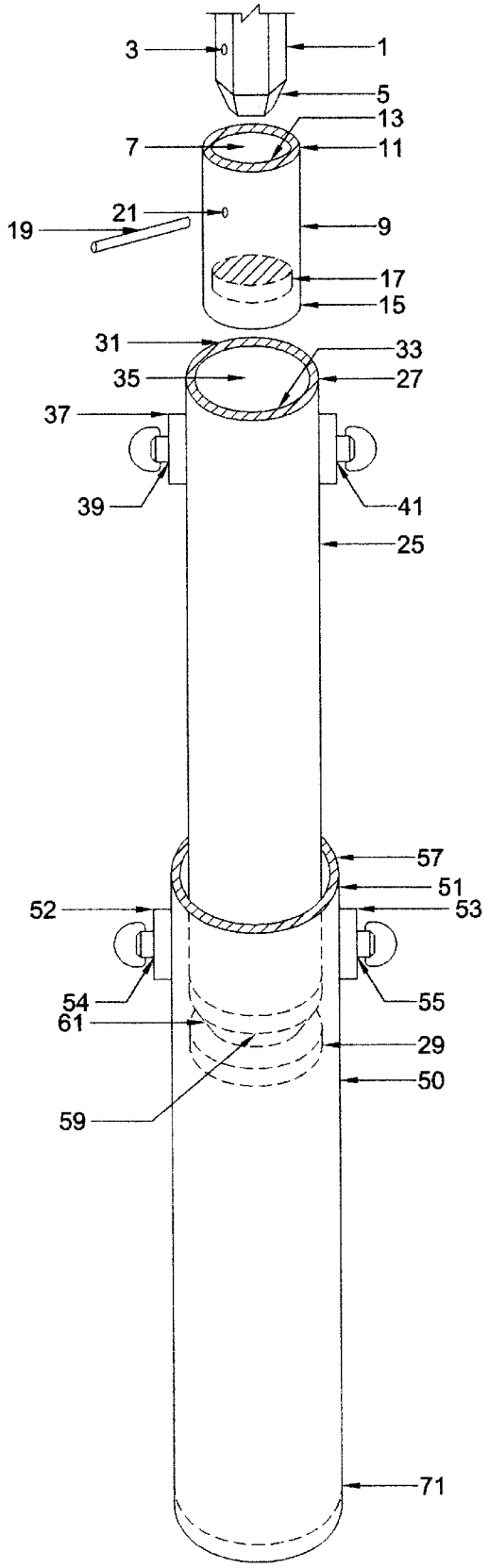
FIG. 1 shows the invention apparatus and its relation to the Kelly Bar attachment.
Figure 6:
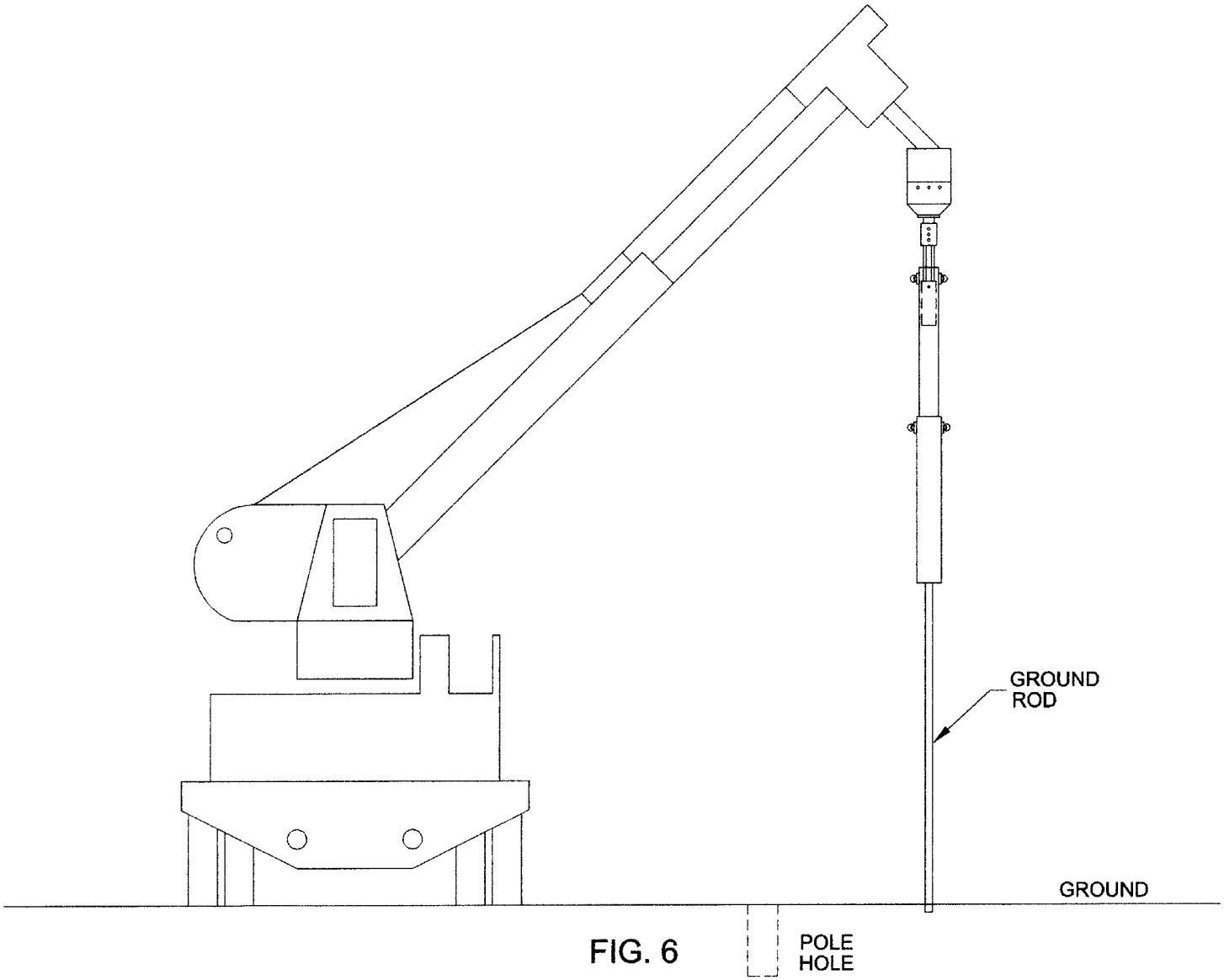
FIG. 6 shows the device in use with the external drive force means.

The invention apparatus is shown substantially in FIG. 1 directly below the Kelly Bar 1. The Kelly Bar is a substantially vertical rigid apparatus to which a drill bit used for drilling holes in the earth is commonly attached. Other attachments exist for the Kelly Bar and it is envisioned that other attachment means exist to an external drive force mechanism. These external drive forces, as shown in FIG. 6, are normally comprised of heavy industrial hydraulic means capable of exerting large forces in an essentially vertical direction. It should be understood throughout that the essentially vertical rigid member 1, although referred to throughout in the industry as a Kelly Bar, can be any vertical rigid means or other attachment means to which the invention in FIG. 1 is attached.

In the preferred mode, the Kelly Bar 1 has at least one or more pin receiving holes 3. The Kelly Bar is shown having a substantially hexagonal shape, and it has a tip 5. This tip 5 is inserted into the first end 7 of the plunger 9 which end 7 is substantially hollow. Said first end has an external circumference 11 having a diameter larger than the diameter of the internal circumference 13. The opposing second end 15 of the plunger is solid and is shown in the preferred mode having a solid rigid member 17 welded or attached thereto so as to act as the means for driving the ground rod. The plunger has means for attaching to the Kelly Bar 1 which means are shown in the preferred mode having a removable pin 19 inserted into and through a hole 21 and corresponding hole 3 so as to secure the plunger to the Kelly Bar.

Once attached to the Kelly Bar as discussed, the elongated rigid tubular telescoping members are placed by sliding members, by sliding the first end over the plunger and locking the same in place so as to prevent the plunger from escaping. In the preferred mode, the cylindrical members are shown as a pair of telescoping members, although any number of telescoping members are also possible. The first telescoping member 25 is shown as a rigid hollow cylindrical member having a first end 27 and a second end 29, and having an outside diameter 31 larger than the internal diameter 33, said internal diameter being sufficiently large so as to allow the plunger, with a slightly smaller external diameter itself, to slidably move within the first telescopic member 25. The first telescopic member is shown as hollow with said plunger entering at the first end 35. The plunger is held slidably in place with locking means near said first end 35, said locking means comprised of what are commonly referred to in the industry as "dogs" 37, having removable locking pins at opposing sides of the first end, 39 and 41, which pins extend sufficiently inside the hollow chamber 35 so as to prevent the plunger from escaping the tube once placed inside the hollow first telescopic member.

Figure 1A:
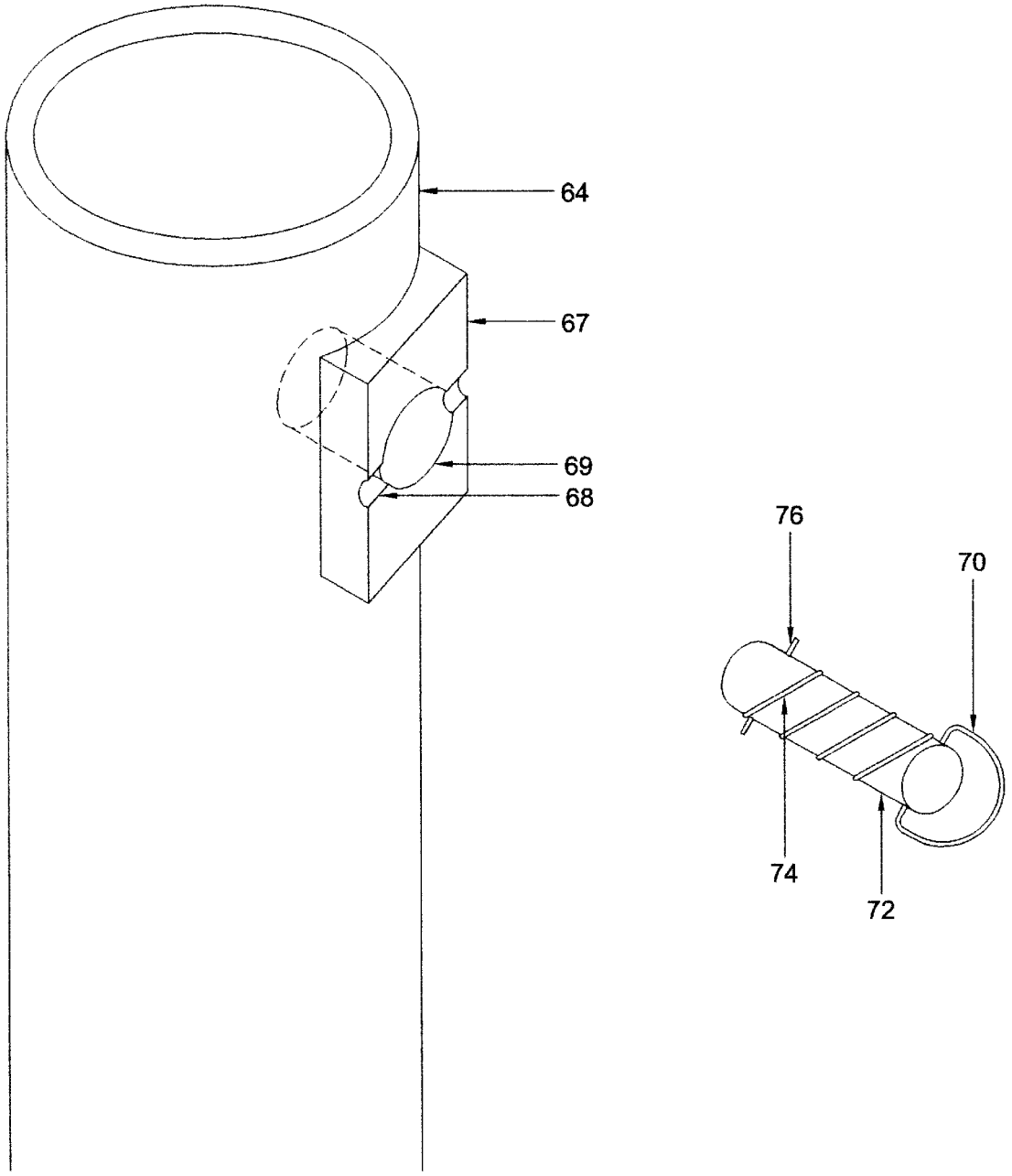
FIG. 1*a* shows a closeup of the "dog" locking mechanism.

The second end of the first telescopic member is in its normal position previously inserted into a second slightly larger hollow rigid elongated telescopic member 50 which is substantially cylindrical in the preferred mode. The second end of the first telescopic member is prevented from escaping by locking means near the first end 51 of the second telescopic member which locking means work in conjunction with corresponding locking means at the second end of the first telescopic member. In the preferred mode, these locking means are comprised of a similar pair of "dogs" 52 and 53 having removable pins 54 and 55 extending, with spring loads forcing them inward, against the exterior 57 of the first telescopic member. The corresponding locking means at the second end 29 is made of a metal stronger than aluminum, preferably steel, and consists of a groove or indented portion 59 sufficient to receive and catch the internal end of said pins 54 and 55 so as to prevent the first telescopic member from sliding out of the first end of the second telescopic member. The indention 59 has a slanted portion 61 allowing the first telescopic member however to move downward so that the pins will be forced outward during the downward motion of the first telescopic member to allow the downward movement of the first telescopic member. These dogs and pins 39, 41, 52 and 53, and their respective assemblies are shown in more detail in FIGS. 1*a* and 4*a* respectively. FIG. 1*a* shows the dogs attached to a telescoping member. The dog body 67 is attached to the telescoping member 64. The dog body has hole 69 for receiving the dog pin 72 and additional indentation 68 for receiving the ring 70 when inserted. The pin has keeper roll pins 76. Spring 74 is therefore maintained on the pin within the dog body so as to provide the tension necessary to keep the ring in place.

Figure 4A:
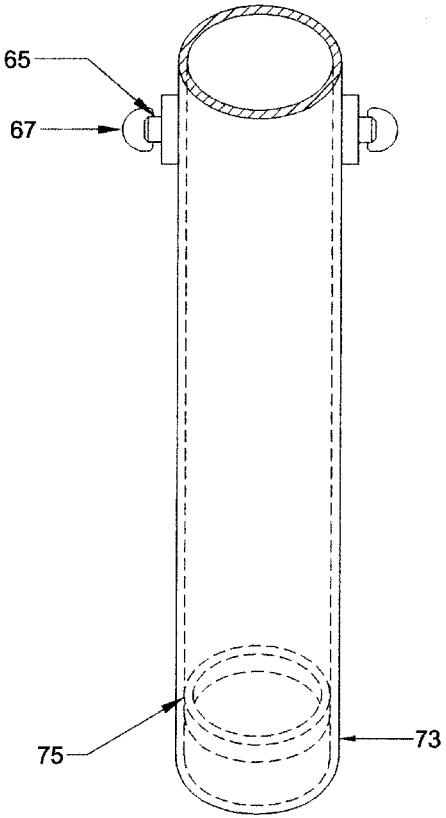
FIG. 4*a* depicts the second telescoping member of the invention apparatus.
Figure 4B:
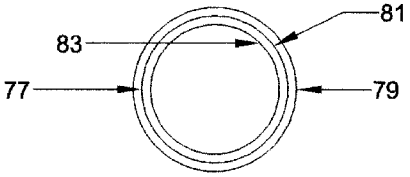
FIG. 4*b* depicts the end view, from the bottom, of the invention apparatus shown in FIG. 4*a*.
Figure 3:
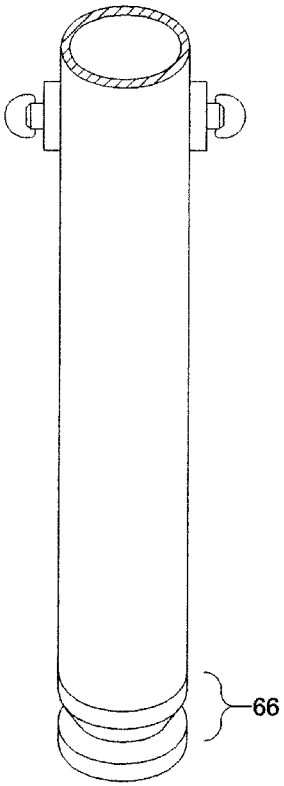
FIG. 3 depicts the first telescoping member of the invention apparatus.

FIG. 4*a* shows the dogs and the indented slot 65 that allows for the twisting of the pin ring 67 by 90 degrees so as to fit within said portion 65 and lock in place. When the pin is pulled and turned again 90 degrees, the pin remains outward so as to allow the respective plunger and/or telescopic member being held in place to be removed. The second telescopic member has a second end 71 also shown as 73 in FIG. 4*a*. Referring to FIG. 4*a*, it will be seen that at the second end of the second telescopic member, there is affixed on the interior walls stop means 75 to prevent the second end of the first telescoping member from exiting. This stop means 75 is also shown in FIG. 4*b* as the cross-hatched area 77 having an internal hollow surface 83 having a diameter smaller than the remainder of the internal surface 81 of the second telescoping member, which internal surface 81 is smaller than the diameter of the external surface 79 of the second telescoping member.

FIGS. 2, 3, 4*a* and 4*b* show in more detail the individual elements of the invention previously described.

Figure 2:
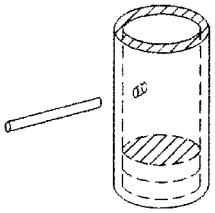
FIG. 2 depicts the plunger element of the invention apparatus.

It is significant that, in the preferred mode, the first and second telescopic members are made of aluminum because of the large mass, with the exception of the dog catching portion 29 and 59 (shown as 66 in FIG. 3) which should be made of steel so as to prevent damage by the dogs. This combination of aluminum and steel as noted allows the device to be lightweight yet strong. The plunger in FIG. 2 is likewise made of steel.

In the preferred mode, the telescoping members are shown as being two in number to allow the telescoping device to be smaller when not in use yet still allow for driving full length eight foot ground rods. The telescoping device extends to approximately eight feet, the length of the ground rod, consequently each of the two members is approximately four feet in length, and the device collapses when not in use, to an approximately four to five foot section making for easy transport. However it is envisioned that additional telescoping members attaching using similar means would be used for collapsing to a smaller device when not in use or for driving longer rods. Moreover, a single cylindrical telescoping member of at least eight feet in length could be utilized although it is somewhat more cumbersome to use. It should be kept in mind that one of the principal purposes of the cylindrical device is to be slightly larger than the ground rod device so as to allow easy and quick insertion of the ground rod device in one smooth essentially continuous and essentially vertical continuous stroke of the external drive means. It should also be kept in mind that the term "essentially vertical" as used herein includes the direction of driving the ground rod into any direction in which ground rods are commonly driven, including ground rods placed at slight angles up to but not including 45° from absolute vertical in relation to the ground level.

Figures 5A, 5B, 5C, 5D, 5E:
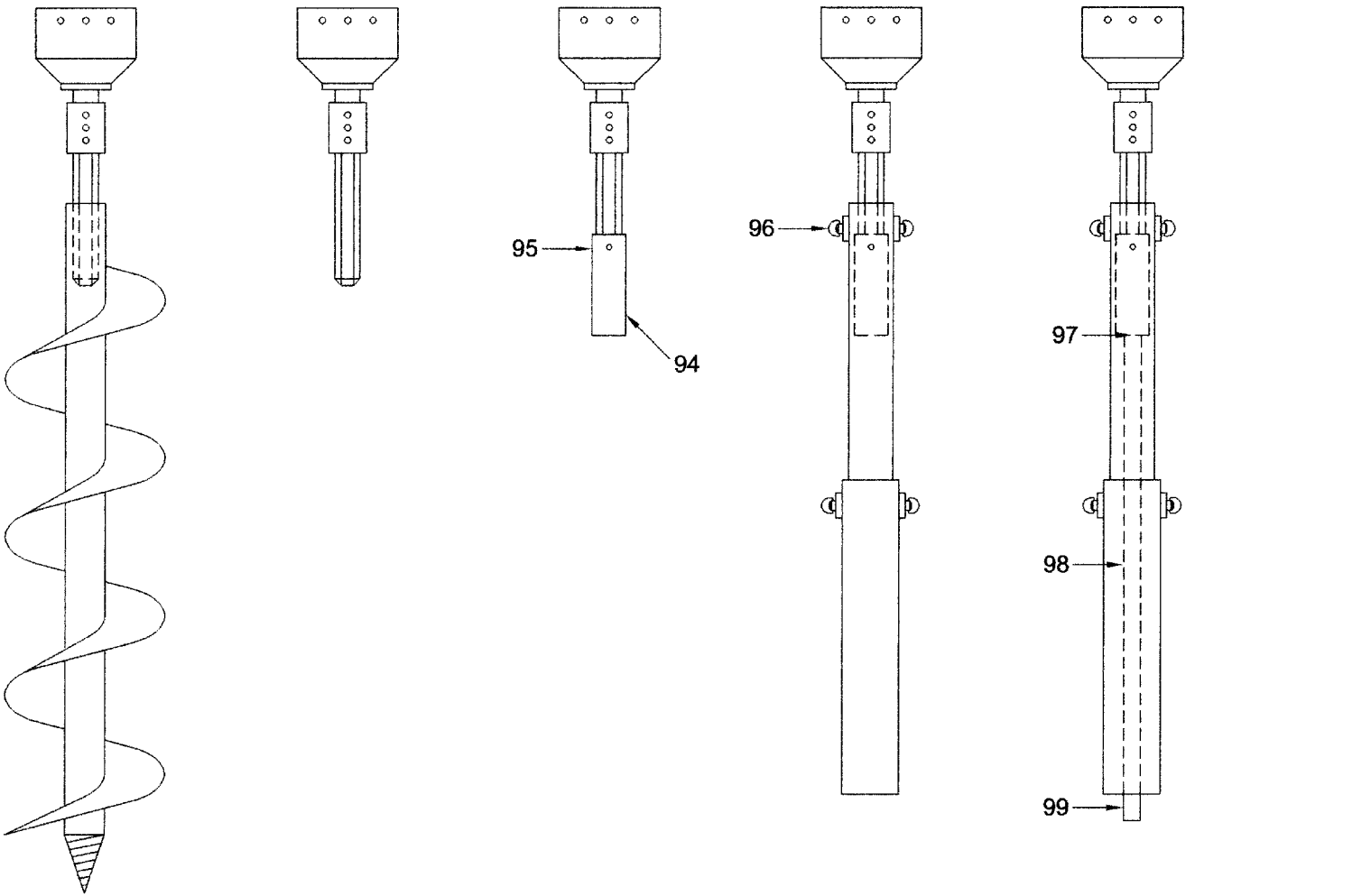
FIGS. 5*a*, 5*b*, 5*c*, 5*d* and 5*e*, show the entire process, starting with the existing drill attached to the Kelly Bar in FIG. 4*a*, to removing the same and attaching the invention apparatus and inserting the ground rod in FIGS. 5*b* through 5*e*.

In use then, as will be seen in FIGS. 5*a* through 5*e*, one simply removes the drill bit 91 from the Kelly Bar 93 in FIG. 5*a*, leaving the Kelly Bar as shown in FIG. 5*b*. The plunger 94 is then attached to the Kelly Bar in FIG. 5*c* utilizing pin 95. The cylindrical telescoping members, already slidably attached to each other, are then affixed to the plunger so as to allow the plunger to be slidably attached to the first telescopic member via pins at 96 in FIG. 5*d*. The Kelly Bar is located over the approximate area where the ground rod is to be inserted. The external drive means are used to raise the Kelly Bar to a level so as to fully extend the two telescoping members with the plunger 97 in FIG. 5*e* to be raised to its fullest extent, with the ground rod 98 shown therein with its end 99 slightly protruding and held in place. The entire assembly is brought downward into the desired essentially vertical direction at the desired location on the ground and the external drive means are further lowered, driving the ground rod end at 97 forcing the ground rod into the earth. The first telescopic member will be seen to fall down into the second telescopic member as the external drive means are lowered, and the plunger is essentially continuously lowered to the second end of the first and second telescopic members, which by the end of the process, are essentially fully collapsed together.

It will be seen that the elongated hollow portions of the telescoping members being slightly larger than the ground rod, allow for keeping the ground rod straight to prevent it from bending during the tremendous forces being placed upon the relatively narrow ground rod during the driving force stage. The entire driving process takes only a matter of seconds, does not require repeated strokes, and allows for easy and reliable insertion of the ground rod. Moreover, if additional ground rods are needed, which is often the case, it is simple to attach to the ground rod end protruding from the ground a simple coupling device, while a second ground rod is inserted to the telescoping member with its protruding end 97 in FIG. 5*e* correspondingly brought down and attached to the coupling device, with the process repeated.

In this manner the plunger drives the second ground rod against the first ground rod, to the desired distance into the ground. This can be repeated with several ground rods to reach depths of 24 feet or more with three standard eight foot length ground rods.

The overall process takes only minutes, including attachment of the invention, and requires no pre-drilling of holes or pre-starting of holes for the ground rod itself.

While there have been shown and described particular embodiments of the invention, it will be obvious to those skilled in the art that changes and modifications may be made without departing from the invention or its equivalent, and, therefore, it is intended by the appended claims to cover all such changes and modifications as fall within the true spirit and scope of the invention.

I claim:

1. A ground rod installation device capable of use with external independent essentially vertical drive means, said installation device comprising:

A. rigid plunging means having means thereon for attaching said plunging means to an external drive means;

B. an elongated rigid hollow device for receiving said plunging means having a first end wherein said plunging means is initially inserted, and a second end, and wherein said first end has removable locking means so as to prevent said plunging means from escaping the first end once inserted into the hollow rigid member.

2. The ground rod installation device in claim 1 wherein the plunging means has a first hollow end and a second solid rigid end, such that the first hollow end allows for receiving the external drive means, and such that the rigid plunging means has at least one removable pin for securing said plunging means to the external drive means.

3. The ground rod installation device in claims 1 or 2 having at least two telescoping members, each telescoping member comprised of an elongated rigid hollow member having a first end and a second end, and each member attached so as to allow the previous telescoping member to slidably extend therethrough, and having removable locking means at the first end of each telescoping section so as to prevent the preceding telescoping section from escaping the first end once inserted.

4. The ground rod installation device of claim 3 wherein the first end of the first telescoping device has removable securing means so as to prevent the plunging means from being removed from said first end yet allows the plunging means to extend through approximately the extension of the first telescoping pipe.

5. The ground rod installation device in claim 4 having corresponding removable locking means near the second end of the first telescopic member and near the first end of the second telescopic member, respectively, so as to allow the first telescopic member to slide throughout said second telescopic member without separating when the two telescopic members are fully extended.

6. The ground rod installation device in claim 5 wherein the removable locking means are comprised of removable pins located near the first end of the second telescopic member extending into the hollow portion of said second telescopic member, and at least one corresponding pin receiving sleeve near the second end of the first telescopic member.

7. The ground rod installation device in claim 6 wherein the means for securing the plunging means within said telescopic member are comprised of at least one removable pin extending into said hollow portion of the first telescopic member a sufficient distance to prevent the plunging means from escaping the said first end once said plunging means is inserted into the first end.

8. The ground rod installation device in claim 6, wherein the second telescoping member has near its second end stop means inside the hollow portion of a sufficient size to prevent the second end of the first telescoping member from escaping the second end of the second telescoping member yet still allow the ground rod to extend through the ends of the telescoping member.

9. The ground rod installation device in claim 4, wherein the means for securing the plunging means within said telescopic member are comprised of at least one removable pin extending into said hollow portion of the first telescopic member a sufficient distance to prevent the plunging means from escaping the said first end once said plunging means is inserted into the first end.

10. The ground rod installation device in claim 4, wherein the second telescoping member has near its second end stop means inside the hollow portion of a sufficient size to prevent the second end of the first telescoping member from escaping the second end of the second telescoping member yet still allow the ground rod to extend through the ends of the telescoping member.

11. The ground rod installation device in claim 5 wherein the means for securing the plunging means within said telescopic member are comprised of at least one removable pin extending into said hollow portion of the first telescopic member a sufficient distance to prevent the plunging means from escaping the said first end once said plunging means is inserted into the first end.

12. The ground rod installation device in claim 5, wherein the second telescoping member has near its second end stop means inside the hollow portion of a sufficient size to prevent the second end of the first telescoping member from escaping the second end of the second telescoping member yet still allow the ground rod to extend through the ends of the telescoping member.

13. A ground rod installation device capable of use with external independent essentially vertical drive means, said installation device comprising:

A. a rigid plunger member having removable attaching means for attaching the rigid plunger element to the external drive means;

B. an elongated rigid hollow first telescopic member having a first open end for receiving the rigid plunger element, said first telescopic member having a second end;

C. an elongated rigid hollow second telescopic member having a first end for receiving the second end of the first telescopic member, and a second end for receiving said ground rod device for installation thereof.

14. A method for inserting a ground rod utilizing an elongated hollow rigid member and rigid plunging means slidable within the elongated hollow member said method comprised of the steps of:

A. removably attaching to said driving means the rigid plunging means and removably attaching the elongated rigid member to the rigid plunging means;

B. locating the elongated hollow rigid member approximately over the area of the earth in which the ground rod is to be installed;

C. inserting the ground rod into one end of the elongated hollow rigid member such that one end of the ground rod is placed against the rigid plunging means;

D. extending the rigid plunging means into the earth utilizing the external drive means so as to press the ground rod device into the earth to the desired distance.

15. A method for installing a ground rod into the earth utilizing an external essentially vertical driving force means having thereon elongated vertical tool bar attaching means, such as that known as a Kelly Bar, for attaching a variety of external attachments, and utilizing an elongated hallow rigid member and rigid plunging means slidably moveable therein said method comprised of:

A. attaching to said elongated vertical tool bar attaching means a plunging means having a first end and a second end, said first end having hollow receiving means for receiving said elongated vertical tool bar attaching means, and said second end comprised of rigid solid means for pressing one end of the ground rod;

B. sliding over said rigid plunging means the first end of an elongated hollow rigid member having said first end and a second end, such that the rigid plunging means is allowed to slidably move within said elongated hollow rigid member;

C. locking said first end of the elongated hollow rigid member closed with said rigid plunging means therein so as to prevent the rigid plunging means from being removed from said first end;

D. locating the elongated hollow rigid member in an essentially vertical position over the approximate location where the ground rod is to be installed;

E. inserting the ground rod into the elongated hollow rigid member such that one end of the ground rod is placed against the rigid plunging means;

F. utilizing said external essentially vertical driving force means, driving the rigid plunging means essentially downward so as to press the ground rod within said elongated hollow rigid member into the earth in one full stroke without repeating and lifting the external essentially vertical force means so as to drive the ground rod its full length into the earth.

* * * * *